United States Patent [19]

Garretson et al.

[11] Patent Number: 4,564,258

[45] Date of Patent: Jan. 14, 1986

[54] PRELOADED ELECTRICAL CONNECTOR

[75] Inventors: Jay H. Garretson; Thomas E. Lazor, both of Warren; John J. Merva, Southington; Charles R. Nestor, Niles; Robert G. Plyler, Vienna; Raymond C. Seiffert, Warren; Jeffrey L. Ziegler, Columbiana, all of Ohio

[73] Assignee: General Motors Corporation, Detroit, Mich.

[21] Appl. No.: 495,632

[22] Filed: May 18, 1983

[51] Int. Cl.[4] ..... H01R 4/24; H01R 4/02

[52] U.S. Cl. ..... 339/220 R; 339/97 P; 339/275 R

[58] Field of Search ..... 339/17 F, 103 M, 176 MF, 339/220 R, 275 B, 97 R, 97 P, 98, 99 R, 275 R, 176 M

[56] References Cited

U.S. PATENT DOCUMENTS

| | | | |
|---|---|---|---|
| 2,794,176 | 5/1957 | Barnes | 339/275 |
| 3,056,103 | 9/1962 | Kulka | 339/220 R |
| 3,189,863 | 6/1965 | Leach | 339/99 R |
| 3,289,148 | 11/1966 | Antes | 339/220 R |
| 3,325,774 | 6/1967 | Tucker, Jr. | 339/220 R |
| 3,409,857 | 11/1968 | O'Neill et al. | 339/220 R |
| 3,493,916 | 2/1970 | Hansen | 339/17 LC |
| 3,601,768 | 8/1971 | Lightner | 339/176 MF |
| 3,617,983 | 11/1971 | Patton | 339/98 |
| 3,760,335 | 9/1973 | Roberts | 339/99 R |
| 3,864,000 | 2/1975 | Coller et al. | 339/17 LC |
| 3,963,319 | 6/1976 | Schumacher | 339/176 MF |
| 4,053,197 | 10/1977 | Teagno | 339/99 R |
| 4,066,316 | 1/1978 | Rollings | 339/97 R |
| 4,097,106 | 6/1978 | Over et al. | 339/99 R |
| 4,159,158 | 6/1979 | Weidler | 339/97 P |
| 4,171,858 | 10/1979 | Knowles et al. | 339/99 R |
| 4,174,877 | 11/1979 | Koederer | 339/97 P |
| 4,346,959 | 8/1982 | Daugherty et al. | 339/217 S |
| 4,365,856 | 12/1982 | Yaegashi et al. | 339/17 F |
| 4,448,477 | 5/1984 | Gladd et al. | 339/256 R |

FOREIGN PATENT DOCUMENTS

| | | | |
|---|---|---|---|
| 1154849 | 4/1964 | Fed. Rep. of Germany . | |
| 2728914 | 1/1979 | Fed. Rep. of Germany . | |
| 3033393 | 4/1981 | Fed. Rep. of Germany | 339/97 R |

*Primary Examiner*—Gil Weidenfeld
*Assistant Examiner*—Gary F. Paumen
*Attorney, Agent, or Firm*—F. J. Fodale

[57] ABSTRACT

A prepared ribbon cable is mass terminated to a preloaded electrical connector by wave soldering techniques. The preloaded connector comprises a housing and a plurality of terminals. The housing has an anvil in the form of a flange at the conductor end of the housing and a plurality of fins projecting from the conductor end to isolate the conductor attaching means of the terminals from each other. The terminals are inserted into cavities through openings at the mating end of the housing, retained by solder tabs which are bent over against the flange, and form part of the conductor attaching means. The conductor attaching means further includes slotted terminal portions which receive the conductors and position the ends of the conductors on the bent solder tabs.

7 Claims, 4 Drawing Figures

PRELOADED ELECTRICAL CONNECTOR

This invention relates generally to electrical connectors and, more particularly, to preloaded electrical connectors for mass termination of a plurality of electrical conductors.

A preloaded electrical connector is one in which several terminals are first loaded into an insulating housing or connector body so that several electrical conductors can be "mass terminated", that is, attached individually to the several terminals in a single operation.

In recent years, the preloaded electrical connector has come into prominent use particularly in high density, miniature electrical connectors having small terminals positioned closely adjacent to each other. These preloaded electrical connectors are usually equipped with "solderless" terminals having wire receiving slots by which the electrical conductors are attached to the terminals in the mass termination operation. See, for example, U.S. Pat. No. 3,760,335 (Roberts) issued Sept. 18, 1973; U.S. Pat. No. 3,963,319 (Schumacher et al) issued June 15, 1976; U.S. Pat. No. 4,097,106 (Over et al) issued June 27, 1978; and U.S. Pat. No. 4,174,877 (Foederer) issued Nov. 20, 1979.

Preloaded electrical connectors of the above noted "solderless" type are often not adequate for use in harsh environments such as an automobile engine compartment where the electrical connectors are subjected to high temperature and considerable vibration. Under such conditions, the terminal portion forming the wire receiving slot tends to relax resulting in a poor electrical interface between the terminal and the electrical conductor particularly in the case of multiple strand conductor wires.

The object of this invention is to provide a preloaded electrical connector adapted for mass terminating several electrical conductors by solder connections.

A feature of the invention is that the terminals are loaded into the housing cavities through openings at the mating end of the housing and locked in the cavities by bending elongated tabs at the attachment end of the terminals against an anvil of the housing. The bent tabs then serve as solder tabs and the housing anvil serves as a dam for mass terminating the several electrical conductors by wave soldering techniques.

Another feature of the invention is that the attachment ends of the terminals have slots which position the electrical conductors on the bent solder tabs for the soldering operation and then serve as a strain relief for the soldered connections.

Still another feature of the invention is that the housing has vertical fins at the conductor end for isolating the attachment ends of the terminals from each other and dividing the solder flow to make discrete solder connections of the individual electrical conductors to the respective solder tabs.

Other objects and features of the invention will become apparent to those skilled in the art as the disclosure is made in the following detailed description of a preferred embodiment of the invention as illustrated in the accompanying sheet of drawing in which.

Figure 1:
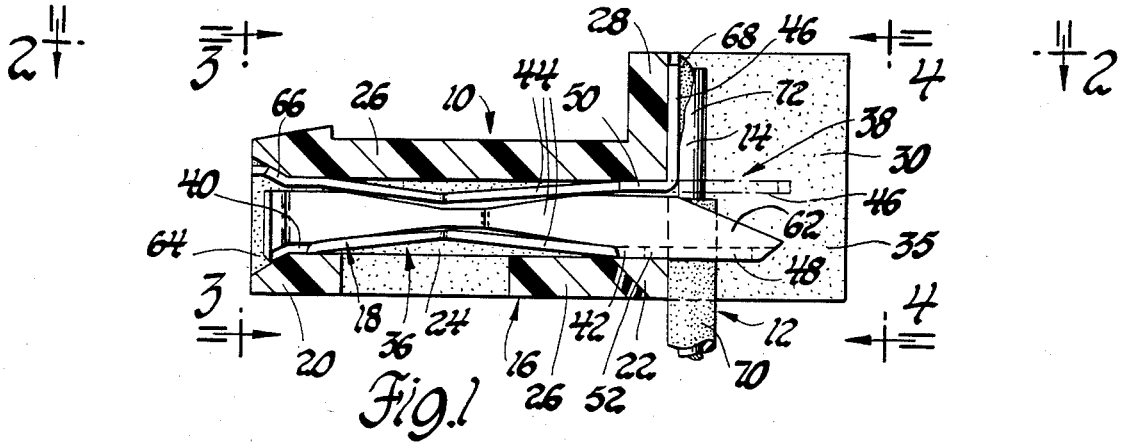
FIG. 1 is a sectional side view of a ribbon cable and a preloaded electrical connector in accordance with this invention attached thereto.
Figure 2:
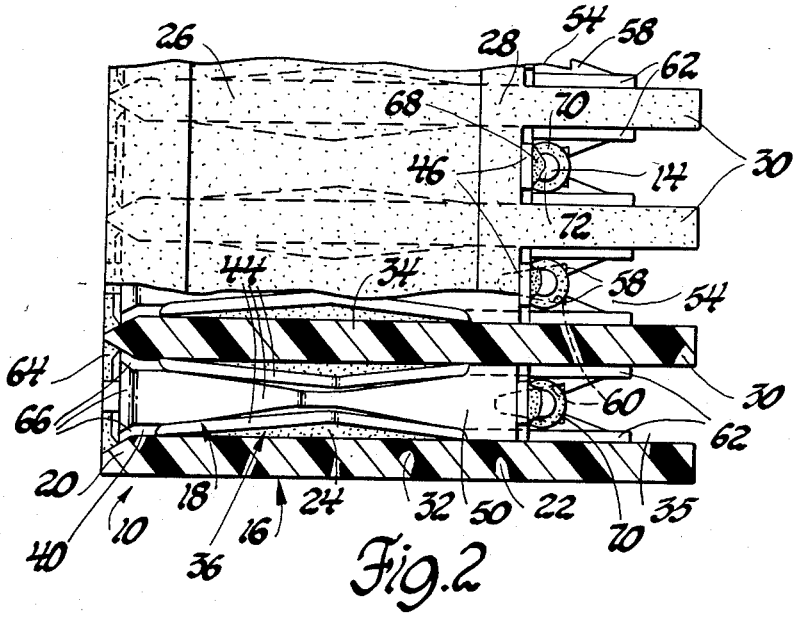
FIG. 2 is a fragmentary, partially sectioned top view of the cable and attached preloaded electrical connector shown in FIG. 1.
Figure 3:
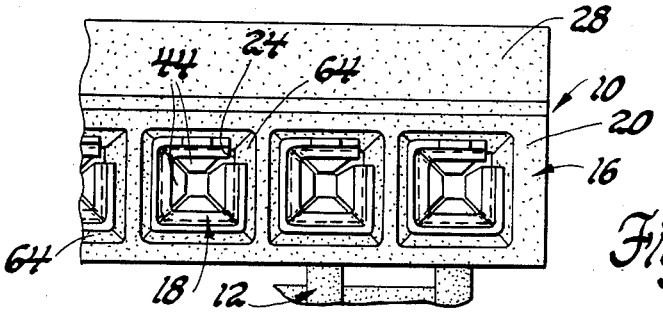
FIG. 3 is a fragmentary front view of the cable and attached preloaded electrical connector shown in FIG. 1.

Referring now to the drawing, FIGS. 1–4 illustrate a preloaded electrical connector 10 attached to the end of a ribbon cable 12 having several parallel spaced electrical conductors 14.

The preloaded electrical connector 10 comprises an insulating housing or connector body 16 and a plurality of electrically conductive terminals 18.

The housing 16 has a mating end 20 which is designed to plug onto a mating electrical connector (not shown), a conductor end 22 which is designed for attaching the electrical conductors 14, and a row of parallel cavities 24 which extend through the housing 16 from the mating end 20 to the conductor end 22.

The housing 16 is rectangular in shape and has two wider side walls 26 which extend across the rows of cavities 24 on the opposite sides thereof. One of the side walls has an anvil of substantial height at the conductor end 22 in the form of a flange 28 which extends across the full width of the housing 16.

The housing 16 also has vertical fins 30 at the conductor end 22 for isolating the protruding end portions of the terminals 18 from each other. The fins 30 are respectively coplanar with the two housing side walls 32 and the several cavity partition walls 34 and extend in cantilever fashion from the conductor end 22 and the flange 28 to form slots 35 which are open at both vertical ends.

The terminals 18 have a contact 36 at one end and electrical conductor attaching means 38 at the opposite end. In this instance, the contacts 36 are generally of the female socket type which is shown in pending patent application U.S. Ser. No. 419,934, filed Sept. 20, 1982, now Pat. No. 4,491,376. Briefly, the female socket contact 36 comprises rectangular end bands 40 and 42, the four sides of which are connected by four inwardly bowed leaf springs 44.

The conductor attaching means 38, however, are unique and form an important part of this invention. More specifically, the conductor attaching means 38 comprise an elongated bendable dual function tab 46 and a dual function holder 48. The elongated tab 46 is integrally connected solely to side 50 of the rectangular end band 42 and it is initially coplanar with the side 50 as shown in dotted lines in FIG. 1.

The holder 48 is U-shaped and it is integrally connected to the remaining three sides of the rectangular end band 42 in coplanar fashion. The bottom member 52 of the U-shaped holder 48 is opposite the tab 46 and it has a generally axial slot 54 which is open at the free end of the member 52. The entrance portion 56 of each slot 54 has side barbs 58 for guiding an insulated conductor into and then retaining the insulated conductor in an inner portion 60 of the slot. The inner portion 60 of the slot converges in the direction toward the contact 36 so that insulated conductors within a range of diameter can be accommodated. The side members 62 of the U-shaped holder 48 provide a stronger support for the bottom member 52.

Figure 4:
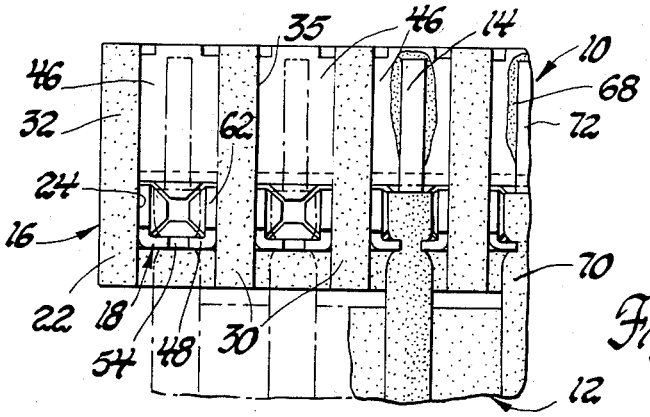
FIG. 4 is a fragmentary rear view of the cable and attached preloaded electrical connector shown in FIG. 1.

The preloaded electrical connector 10 is assembled by inserting the terminals 18 into the cavities 24, conductor attachment end first, through openings 64 at the mating end 20 of the housing 16 until the flared portions 66 of the end bands 40 engage chamfers in the openings 64. The terminals 18 are then locked in the cavities 24 by bending the elongated tabs 46 upright against the flange 28 as shown in solid lines in FIG. 1. The bent or upright tabs 46 are still elongated and preferably extend to the end of the flange 28 as shown in FIG. 4. In any event, the bent tabs 46 and flange 28 should be of sufficient height to form solder connections 68 therebetween which are spaced from the cavities 24 by a sufficient amount to protect against solder entering the cavities 24.

The preloaded electrical connector 10 is then attached to a ribbon cable 12 which is prepared by notching the end portion to provide insulated end portions 70 having protruding conductor ends 72 as best shown in FIG. 4. Each of the insulated end portions 70 is forced into the inner portion 60 of the axial holder slot 54 of one of the terminals 18 which positions the protruding conductor end 72 on the bent tab 46. If desired, the conductor ends 72 may be trimmed using the flange 28 as a machine guide to assure that the conductor ends 72 do not protrude out of the slots 35. The several solder connections 68 are then made simultaneously by conventional wave soldering techniques and in this regard it is important that the slots 35 are open at the ends adjacent the solder connections 68.

We wish it to be understood that we do not desire to be limited to the exact details of construction shown and described, for obvious modifications will occur to a person skilled in the art.

The embodiments of the invention in which an exclusive property or privilege is claimed are defined as follows:

1. A preloaded electrical connector for mass terminating a plurality of electrical conductors, comprising a housing having a mating end, a conductor end and a row of parallel cavities extending therethrough from the mating end to the conductor end, said housing having opposite side walls extending across the row of parallel cavities and a flange on one of said side walls at the conductor end of the housing, a plurality of terminals having contacts at one end and electrical conductor attaching means at the opposite end which include bendable solder tabs, said terminals being inserted into the cavities through openings at the mating end of the housing, opposite end first and being retained therein by said solder tabs being bent over against the flange, said conductor attaching means being disposed outside of the cavities and further including slotted portions transverse to and spaced from the bent solder tabs for receiving the electrical conductors and positioning the ends of the electrical conductors on the bent solder tabs, and said housing further including a plurality of cantilevered fins at the conductor end which isolates the electrical conductor attaching means of the terminals from each other.

2. The preloaded electrical connector as defined in claim 1 wherein the opposite side walls have respective end walls on the opposite sides of the terminal cavities at the conductor end of the housing which are substantially coplanar with an end wall of the flange and wherein the solder tabs are bent over against the said end wall of the flange.

3. The preloaded electrical connector as defined in claim 1 wherein the cantilevered fins form slots which are open at both vertical ends.

4. The preloaded connector as defined in claim 1 wherein the terminals have an intermediate rectangular band, wherein the bendable solder tabs are integrally connected solely to one side of the rectangular band, and wherein the electrical conductor attaching means further include U-shaped holders which are integrally connected to the remaining three sides of the rectangular band in coplanar fashion and wherein the bottom members of the U-shaped holders have generally axial slots which are open at the free ends of the members to provide the slotted portions transverse to and spaced from the bent solder tabs.

5. A preloaded electrical connector for mass terminating a plurality of electrical conductors, comprising a housing having a mating end, a conductor end and a row of parallel cavities extending therethrough from the mating end to the conductor end, said housing having opposite side walls extending across the row of parallel cavities and a flange extending outwardly of one of said side walls to provide an end wall of substantial height at the conductor end of the housing, a plurality of terminals having contacts at one end and electrical conductor attaching means at the opposite end which include bendable elongated solder tabs, said terminals being inserted into the cavities through openings at the mating end of the housing, opposite end first and being retained therein by said elongated solder tabs being bent over against the flange to provide elongated portions adjacent the end wall which extend outwardly of the one side wall, said conductor attaching means being disposed outside of the cavities and further including slotted portions transverse to and spaced from the bent solder tabs for receiving the electrical conductors and positioning the ends of the electrical conductors on the bent over elongated portions of the solder tabs, and said housing further including a plurality of cantilevered fins at the conductor end which extend outwardly of the one side wall and which isolate the electrical conductor attaching means of the terminals from each other.

6. The preloaded electrical connector as defined in claim 5 wherein the other of said side walls has an end wall at the conductor end of the housing which is substantially coplanar with the end wall of the one side wall and the flange, and wherein the cantilevered fins are completely open rearwardly of the aforesaid end walls.

7. The preloaded connector as defined in claim 5 wherein the terminals have an intermediate rectangular band, wherein the bendable solder tabs are integrally connected solely to one side of the rectangular band, and wherein the electrical conductor attaching means further include U-shaped holders which are integrally connected to the remaining three sides of the rectangular band in coplanar fashion and wherein the bottom members of the U-shaped holders have generally axial slots which are open at the free ends of the members to provide the slotted portions transverse to and spaced from the bent solder tabs.

* * * * *